11/22/83 XR 4,416,494

United States Patent [19]

Watkins et al.

[11] 4,416,494

[45] Nov. 22, 1983

[54] APPARATUS FOR MAINTAINING A COILED ELECTRIC CONDUCTOR IN A DRILL STRING

[75] Inventors: Larry A. Watkins; Leon H. Robinson, Jr., both of Houston, Tex.

[73] Assignee: Exxon Production Research Co., Houston, Tex.

[21] Appl. No.: 194,098

[22] Filed: Oct. 6, 1980

[51] Int. Cl.[3] ..... H01R 4/64

[52] U.S. Cl. ..... 339/15; 73/152; 175/45

[58] Field of Search ..... 175/40, 45, 57; 339/119 C, 15 R, 16 R; 73/152–154

[56] References Cited

U.S. PATENT DOCUMENTS

| | | | |
|---|---|---|---|
| 2,706,616 | 4/1955 | Osmum | 339/16 R X |
| 2,847,655 | 8/1958 | Schurman | 339/16 R X |
| 3,817,345 | 6/1974 | Bailey | 175/40 X |
| 4,245,313 | 1/1981 | Coates | 73/152 X |
| 4,319,240 | 3/1982 | Stone et al. | 339/16 R X |

*Primary Examiner*—Eugene F. Desmond
*Attorney, Agent, or Firm*—E. Thomas Wheelock

[57] ABSTRACT

Apparatus for downhole storage of an electrical conductor within a drill string in a borehole. The conductor is stored as a coil in a flexible storage means. The apparatus is desirably used to eliminate the short lengths of cable and the associated connectors which are normally added with each new section of drill pipe added to the drill string. Because the device is flexible, it may be used in deviated drilling.

37 Claims, 11 Drawing Figures

APPARATUS FOR MAINTAINING A COILED ELECTRIC CONDUCTOR IN A DRILL STRING

BACKGROUND OF THE INVENTION

This invention relates to apparatus for maintaining electrical continuity through an insulated electrical conductor employed in a drill string. The invention can be used in wellbore telemetry operations or other operations where electric energy is transmitted between subsurface locations and the surface. It particularly relates to an improved method and apparatus for storing insulated electrical conductor downhole as a coil in a storage container.

In the drilling of oil wells, gas wells or other boreholes, it frequently is desirable to transmit electric energy between subsurface and surface locations. One particularly important method receiving considerable attention in recent years is found in the use of a wellbore telemetry system designed to sense, transmit and receive information indicative of a subsurface condition or subsurface position. This system may include a downhole sensor mounted in the drill string above the drill bit. Processes using this generic apparatus have become known in the art as "logging while drilling" or "measurement while drilling", or simply "MWD".

A major problem associated with wellbore telemetry systems has been that of providing reliable means for transmitting an electric signal between the subsurface and surface locations. This problem can best be appreciated by considering the manner in which rotary drilling operations are normally performed. In conventional rotary drilling, a borehole is advanced by rotating a drilling string provided with a drill bit at its lower end. Sections of drill pipe, usually about 30 feet long, are added to the drill string, one at a time, as the borehole is advanced in increments. In adapting an electric telemetry system to rotary drilling equipment, the means for transmitting the electric signal through the drill string must allow the connection of additional pipe sections to the drill string as the borehole is advanced.

An early approach to the problem involved the use of continuous electric cable which was adapted to be lowered inside the drill string and to make contact with a subsurface terminal. This technique, however, requires withdrawing the cable from the drill string each time a pipe section was added to the drill string. Another approach involves the use of special drill pipe. Each pipe section of the special pipe is provided with an electric conductor having connectors at its opposite ends. Electrical continuity is maintained across the junction of two pipe sections by permitting a connector of one section to contact a connector on the adjacent pipe section (See U.S. Pat. Nos. 3,518,608 and 3,518,609). Disadvantages of this system include the high cost of the special pipe sections, the need for a large number of electric connections (one at each joint), and the difficulty of maintaining insulation of the electric connectors at each joint.

Still another approach involves the use of a cable section mounted in each pipe section (See U.S. Pat. No. 2,748,358). The cable sections are connected together as pipe sections are added to the drill string. Each cable section is normally made slightly longer than its associated pipe section, with the result that a small amount of slack is present in the conductor string at all times. Drilling fluid flowing through the drill string exerts a fluid drag on the loose cable and tends to damage the connectors and snarl the cable.

Another development in cable systems for wellbore telemetry operations is described in U.S. Pat. No. 3,825,078 on "Method of Mounting and Maintaining an Electric Conductor in a Drill String" and its divisional U.S. Pat. No. 3,913,688 on "Apparatus for Mounting Electric Conductor in a Drill String." The cable system disclosed in these patents employs a looped cable which permits the cable string to be extended as the drill string is lengthened. Experience with this system has indicated that the overlapped cable sometimes becomes entangled as a result of pipe rotation or fluid flow in the pipe setting. Although this patent suggests that downhole storage of coiled electric conductor is possible, it does not provide any method by which it can be done.

A method for preventing looped cable from tangling is described in U.S. Pat. No. 3,825,079 on "Method For Mounting An Electric Conductor in a Drill String" and its divisional U.S. Pat. No. 3,918,537 on "Apparatus for Maintaining an Electric Conductor in a Drill String." In accordance with one embodiment of these patents, entanglement of the overlapped cable is minimized by providing a track between a fixed upper support and lower axially movable weight. The support and the weight maintain the cable in an overlapped configuration, allowing stored cable to be withdrawn as drilling progresses, but minimize twisting of the looped cable. However, this system is cumbersome since it requires long track sections which must be lowered into and withdrawn from the pipe string. Furthermore, the length of cable which can be stored is somewhat limited.

An apparatus for storing coiled electric cable within a storage container inside a drill string is disclosed in U.S. Pat. No. 3,904,840 entitled "Wellbore Telemetry Apparatus." The cable within this apparatus is incrementally dispensed on demand during drilling operations via the use of clutch and gripper means. When tension on the conductor reaches some predetermined value, the gripper releases thereby allowing an amount of coiled cable to leave the storage container. The apparatus has no provision for self-restoration of the coiled cable. The coil itself is not disclosed to have any "spring" to it. Consequently, the coil must be returned to its storage container in a special operation on the surface.

An additional improvement to the operability of the looped cable methods noted above is described in U.S. Pat. No. 3,957,118 on "Cable System for Use in a Pipe String and Method for Installing and Using the Same." A disengageable cable gripping device is positioned on the pulley in the fixed upper support thereby maintaining tension on the portion of the conducting cable between the subsurface location and that upper support pulley. By maintaining this lower cable in tension, the tendency of the overlapping portions of the cable to tangle is substantially reduced.

Another disclosed improvement in the cable-gripping method entails the use of a device which prevents the upper and lower pulley assemblies from rotating with respect to each other. U.S. Pat. No. 4,098,342 additionally describes the desirability of placing cable guides at various intervals between the upper and lower pulley assemblies.

The disclosure in U.S. Pat. No. 4,181,184, to Scherbatskoy, relates to a method of storing unordered telemetry cable in the drill string. This method calls for using a softwire conductor having an insulation coating which is sufficiently flexible to permit random storage of the conductor within the drill pipe and yet springy enough to make possible a reasonably smooth extension of the wire after storage.

The downhole storage of very short length of cable is suggested in U.S. Pat. No. 2,706,616. The patent discloses a jar made up of two rigid telescoping tubes forming a cavity having therein a coiled conductor cable. The invention permits operation of the jar in a conductor string without effecting the electrical circuit through the equipment. The coiled conductor is not self-restoring after release nor is it mounted in a flexible housing.

Clearly, each of these inventions requires significant care in achieving successful downhole storage of electric cable. Only a few of these inventions provide for self-restoring cable storage during drilling. Most rely on the effect of gravity to prevent entanglement of the overlapping segments of the cable.

SUMMARY OF THE INVENTION

The broad purpose of the present invention is to provide an electrical circuit between a subsurface location in a well and the surface, thereby permitting the monitoring of some subsurface condition during drilling operations. In particular, this invention is a simple apparatus for storing electrical cable inside a drill pipe. The invention, is a long, thin, and flexible enclosure, which may be up to 1000 feet long or more, placed within the drill string having within it a coil which, when relaxed, tends to contract and fill only a part of the enclosure. The coil is attached to the enclosure at its lower end and, at its upper end, to a length of wire extending out of the enclosure. By hanging the enclosure at its upper end within the drill string, the wire stored in the enclosure is available and may be withdrawn as necessary by a mere pull. It is contemplated that the coil and its attached wire may function as the electrical conductor passing electrical information to the surface or it may be only a carrier for a separate information conductor.

A novel aspect of this invention resides in the use of the enclosure called a coiled wire storage means. During normal operations the storage means would be essentially fixed in the drillstring relative to the downhole instrumentation and the drill bit. This is accomplished by securing the upper end of the storage means to the drill pipe. The electrical wire or logging cable extending between the downhole instrumentation and the lower end of the storage means is physically and electrically secured at each of those positions. Electrical continuity is maintained through the storage means in the manner mentioned above, and the wire extending from its upper end is attached to logging cables extending to the surface. The structure of the coil is not particularly important to the invention. However, depending upon its chosen physical characteristics, i.e., wire size and composition, and the desire to prevent overextension, the retracted coil may fill only one-sixth to one-half of the coil storage means. A stop is attached to the upper or extensile wire at some point between the upper end of the coil and the upper interior end of the coil storage means. The stop is of such a configuration that is cannot pass the upper end of the storage means and is placed at such a point on the wire that the coil will not be overextended. Clearly the coil is not permitted to leave the storage means. The stop may be sized to function as a weight and therefore provide an amount of tension on the length of cable or wire extending to the surface.

As drilling operations proceed, the drill string is lengthened. The wire, stored in the form of a spring, can be extended from the coil storage means by an upward pull and fed through each individual pipe section as it is added to the top of the pipe string.

An important advantage of the invention over prior art techniques lies in its simplicity of use. The overlapping cable loops found in the prior art are absent and hence none of the required methods for preventing cable self-entanglement are needed. No special cable guides or rotation-limiting equipment is necessary to maintain the cable in a special alignment. No subsurface cable-gripping mechanism is in contact with the drilling fluid. In its most desirable configuration, the coil storage means can be inserted into the well much in the same manner as is the attached logging cable. Since the invention does not rely on the presence of gravity to maintain the stored cable in a usable condition, the invention may be used in any borehole including those which are not vertical and especially in boreholes having the high hole angles found in deviated drilling. It is further contemplated that this invention has application in drilling boreholes used for purposes other than as wells, e.g., underground river crossings for pipelines and gas bleed holes in coal seams. In such instances, as in the case of deviated wells, knowledge of the downhole position of the drill bit is most desirable.

DESCRIPTION OF THE PREFERRED EMBODIMENT

Figure 1:
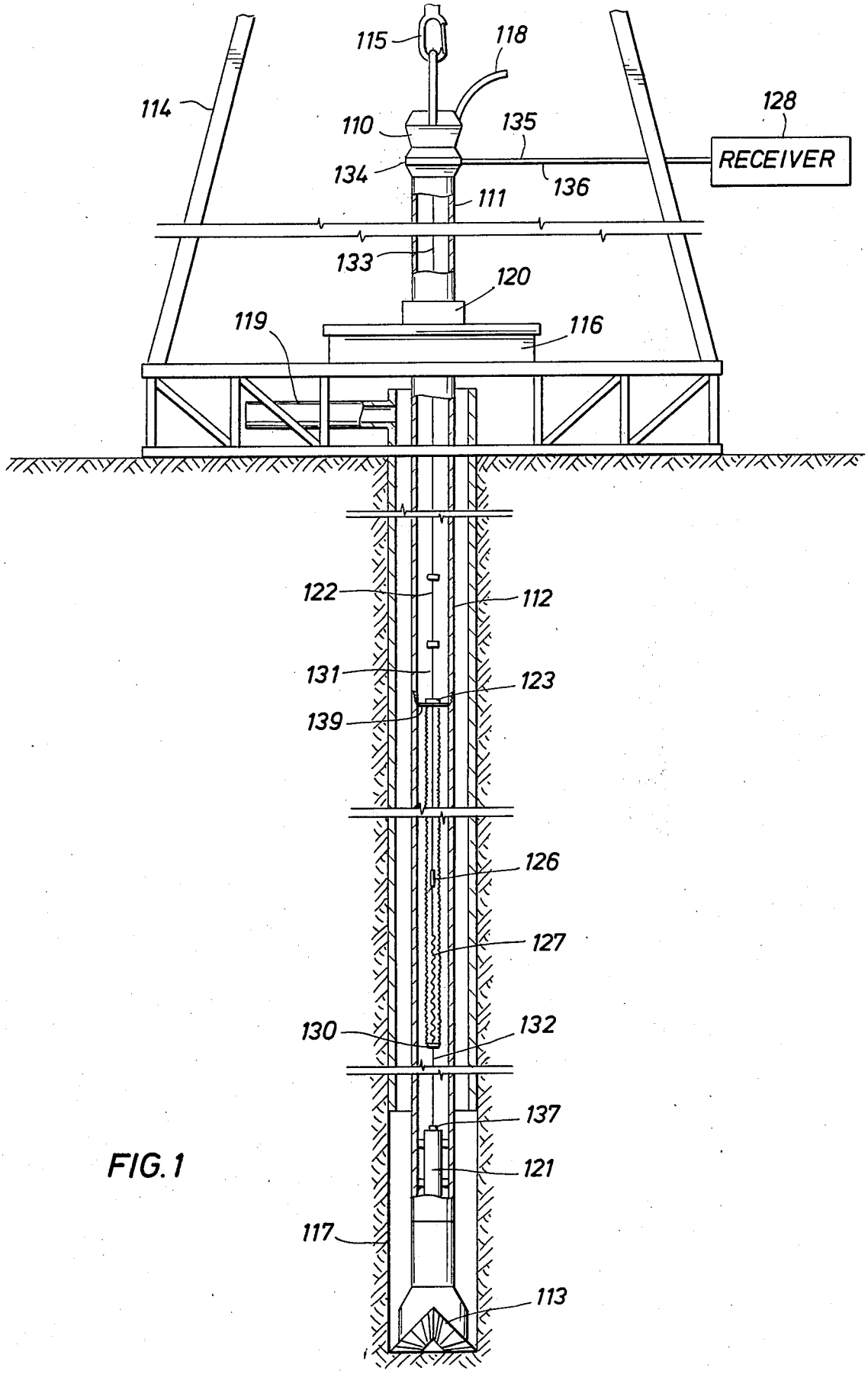
FIG. 1 is a schematic view of well drilling equipment embodying the invention and having an electric conductor for transmitting an electric signal between a subsurface location and the surface.

Conventional rotary drilling equipment, as schematized in FIG. 1, includes swivel 110, kelly 111, tubular drill string 112, and bit 113. These components, connected in the manner illustrated, are suspended from the drilling derrick 114 by means of rig hoisting equipment 115. The kelly 111 passes through rotary table 116 and connects to the upper end of the drill string 112. The term "drill string" as used herein refers to the column of pipe between the bit 113 and the kelly 111; and the term "pipe string" refers to the complete pipe column including the kelly 111. The major portion of the drill string 112 normally is composed of detachable sections of drill pipe. The lower section of the drill string, i.e., above the drill bit and below the drill pipe, is made up of drill collars which weight and stabilize the drill bit.

The borehole 117 is advanced by rotating the drill string 112 and bit 113 while pumping drilling fluid down through the drill string 112, out the drill bit 113 and back up the annulus formed by the borehole wall and drill string 112. The drilling fluid is introduced to the drill string 112 via swivel 110 through a hose (not shown) attached to hose connection 118. The drilling fluid, containing various downhole detritus, exits the well through pipe 119. A kelly bushing 120 couples the rotary table 116 to the kelly 111 and provides means for transmitting power from the rotary table 116 to the drill string 112 and thence to bit 113. It should be noted that the use of a power swivel eliminates the need for a kelly and rotary table. The present invention may also be used in systems which employ a power swivel in lieu of a kelly and rotary table; for purposes of illustration, the present invention is described in connection with the kelly and rotary table arrangement.

As mentioned previously, it frequently is desirable to monitor a subsurface condition or position during drilling operations. This requires measuring a physical condition at the subsurface location, transmitting this data as an electric signal to the surface, and reducing the signal to useful form. Typical situations where telemetry is applicable in drilling operations include drilling through abnormal pressure zones, drilling through zones where hole deviation is likely to be a problem, directional drilling, exploratory drilling, and the like.

Although the present invention may be employed in almost any drilling operation wherein an electric conductor is used in tubular pipe to transmit electric energy between a subsurface and surface location, it finds particularly advantageous application in a wellbore telemetry system such as that illustrated in FIG. 1 which comprises a sensor or instrument 121, receiver 128 and the connecting conductive cables, i.e., upper cable 122, extensile wire 131, coil 127 and lower cable 132.

The term "cable" as used herein when discussing telemetry refers to any size electric conductor. Such cables include insulated single-conductor cable or multi-conductor cable. Wellbore telemetry cable preferably is armored with wire or bands.

The instrument 121, capable of measuring a subsurface condition or parameter and generating an electric signal indicative or representative of that condition, is normally mounted above bit 113 in the drill string 112. In some instances the drill bit itself may be used as a sensor. A variety of devices capable of sensing a physical condition is available. These include transducers for measuring pressure, temperature, strain, and the like; instruments for measuring mud properties such as electrical resistivity, density or gas content; surveying instruments for measuring hole deviation; and logging instruments for measuring resistivity or other properties of subsurface formations. The instrument 121 may be powered by batteries or by energy transmitted from the surface through the cables. Alternatively, a subsurface generator driven by fluid flowing through the drill string 112 may be used to power instrument 121.

The information transmitted through the cables may be a signal generated by the subsurface instrument 121 and transmitted to the receiver 128 at the surface. Alternatively, the energy may be electric power transmitted from the surface to actuate or drive a subsurface instrument or motor. Also, energy may be transmitted down the cables to power the instrument 121, and simultaneously intelligence may be transmitted up the same conductor.

In telemetry operations, it is preferred that the information be sent in the form of a pulsating signal. Information can be transmitted by varying the number, amplitude, width or spacing of a train of electric pulses, or it can be transmitted by modulating the frequency or amplitude of the pulsating signal. More than one transducer or other device may be employed in the system, in which case a multiplexer may be used for sending the various signals over a single conductor.

Electrical continuity to the surface is maintained through coil 127, extensile wire 131, upper cable 122 and kelly cable 133. In this embodiment, the kelly cable 133 extends through the kelly 111 and connects to a terminal located in the upper end at the kelly 111. It should be observed that kelly cable 133 may be embedded in kelly 111. In that case upper cable 122 would extend to the upper end of drill string 112 and connect to kelly cable 133 at that location.

If telemetry operations are to be performed while the kelly 111 and drill string 112 are rotating, the upper end of kelly cable 133 will be connected to a device 134 capable of conducting electrical signals from a rotating member to a stationary member. Device 134 may be a rotary transformer having a rotor secured to the kelly 111 and a stator attached to the stationary portion of swivel 110, or it may be a slip ring and brush assembly. Device 134 and electrical conductor 135 provide means for transmitting signals from the cables within the pipe string to the receiver 128. Conductor 136 connects the stationary portion of device 134 with receiver 128. The return path for the electric circuit may be provided by a variety of grounding circuits but preferably is through the pipe string or conductor armor. If telemetry operations are to be performed at times when the drill string 112 and kelly 111 are stationary, device 134 is not necessary and conductors 135 and 136 may be connected directly to upper cable 122 and electrical ground through a suitable connector. In such a situation, conductors 135 and 136 would be disconnected when the kelly 111 and drill string 112 are in use. Other means for conveying the signal to the receiver 128 include a wireless transmitter connected to either upper cable 122 or kelly cable 133 and located on a rotating member, e.g. kelly 111.

The receiver 128 is an instrument capable of receiving the signal generated by instrument 121 and translating it into a useful form.

The coil housing means is held in position within the drill string by the "hang-off" means 139 which is detachably attached to the upper coil housing fitting 123.

Figure 2A:
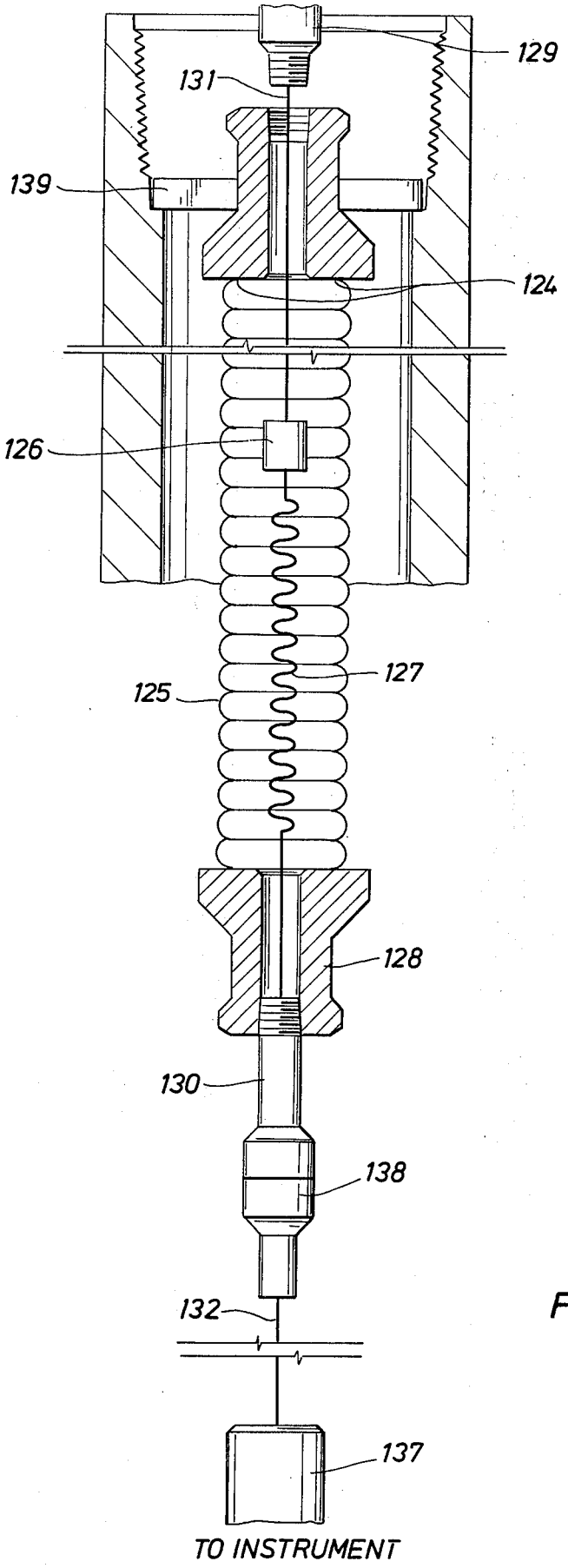
FIG. 2A is a generalized view of the components of the coiled wire storage means.

In the preferred embodiment of the present invention, shown in FIG. 2A, the coiled wire storage means comprises an upper coil housing support 123, a metal corrugated hose forming the coil housing 125, and a lower coil housing fitting 128. Within the coil housing resides a coil 127 attached to the lower coil housing fitting 128 and an extensile wire 131 attached to the coil which extends out the top of the housing through the upper coil housing support 123. A cable stop 126 is fitted at an appropriate spot on the extensile wire to prevent overextension of the coil by contact with shoulders 124. Typically, a set of upper 129 and lower 130 cable connectors are also attached.

In use, lower cable 132 extends between an instrument (such as 121 in FIG. 1) to lower cable connector 130 and is desirably attached to the instrument via a blind instrument latch 137 having the necessary electrical connections therein. Lower cable connector 130 may be integral with lower coil housing fitting 128; it also may be attached to lower coil housing fitting 128 (as is illustrated in FIG. 2A) or may be at the end of a length of cable.

As mentioned above, the apparatus for storing the coiled cable, illustrated in FIG. 2A, includes an upper coil housing support 123. This support is restrained from downward axial movement in the drill string by attachment to a "hang-off" 139 mounted, inter alia, at a junction between sections of drill pipe or in a sub inserted in the drill stem especially for this purpose. The "hang-off" 139 is of such size as to permit the smaller coil housing 125 to pass, without interference, through its center but restrain the larger diameter upper coil housing support 123 from downward movement. Suitable designs for hang-offs are depicted in U.S. Pat. No. 4,181,184, mentioned above. Both the "hang-off" 139 and the upper coil housing support 123 must be of sufficient strength to support the effective weight of the coiled wire housing zone and the cables connected to its lower end. The "hang-off" 139 and the upper coil housing support 123 may allow the downward flow of drilling fluids both around and through the coil housing 125. It should be noted that proper operation of the invention apparatus may entail the presence of a fluid, preferably the drilling fluid, within housing 125. The method by which this fluid is introduced to the housing 125, whether by pre-filling on the surface or by providing holes in at least one of the upper coil housing support 123 or lower coil housing fitting 128 so as to allow drilling fluids to pass, is not a critical feature of this invention.

The coil housing 125 is desirably constructed from a corrugated metal hose although other materials, such as rubber hose, reinforced rubber hose, braided metal hose, etc. are acceptable if proper attention is made to design and sizing of the coil. The hose may be screwed, welded, or swaged to the upper coil housing support 123 and lower coil housing fitting 128. In the preferred embodiment, the hose making up the housing has the following characteristics: it is of a suitable stainless steel and hence able to withstand corrosive downhole conditions; it has a bending radius such that it can be used with existing well equipment, i.e., the sheave used to feed telemetry cable into the drill string; it should be severable with bolt cutters so that in the event it is dropped in the pipe, it can be cut as the drill string is tripped out of the hole; and it must be of sufficient strength and dimensional stability that the diameter of the hose does not decrease during use to the point it interferes with movement and contraction of coil 127. Should problems with binding between the enclosed coil 127 and the coil housing occur, e.g., during coil restoration, it may be necessary to coat the interior of the coil housing 125 with a layer of an anti-friction composition such as TEFLON. A flexible metallic hose suitable for use as the coil housing 125 is TITEFLEX 227. This commercially available hose has a 316L stainless steel corrugated innercore and a double layer of 321 stainless steel braid covering. Testing of 1" I.D. samples of this hose by stressing to 4000 pounds showed only 1%–2% reduction in average diameter. The outer diameter of the housing is effectively limited by the inner diameter of the drill pipe sections through which it is snaked. The nominal I.D. of drill pipe is 3.8 inches and that of a typical tool joint is $2\frac{7}{8}$ inches. There should be room outside the coil housing 125 for flow of drilling fluids.

It is contemplated that coil housing lengths of from 200 feet to 1000 feet or more are within the purview of the invention.

The lower coil housing fitting 128 desirably is threaded, welded, or swaged onto the coil housing 125. It is also physically attached to coil 127. The major function of lower coil housing fitting 128 is to transfer mechanical tension loads from the cables attached below it (via lower cable connector 130) to the coil housing 125 while maintaining electrical continuity between those lower cables and the enclosed coil 127. Drilling fluids must be able to pass the outside of the fitting. These fluids may also pass through holes optionally placed in the fitting. Lower cable connector 130 may also be integral with lower coil housing fitting 128 or merely attached thereto. Lower cable connector 130 is attached to a mating connector 138, lower cable 132 and a blind instrument latch 137.

Coil 127, as mentioned above, is always mechanically attached to lower coil housing fitting 128 but may be electrically isolated therefrom. If the coil 127 is used as the conductor through which information passes, then the conductors in coil 127 are connected to an insulated "pass-through" in lower coil housing fitting 128.

Figure 2B:
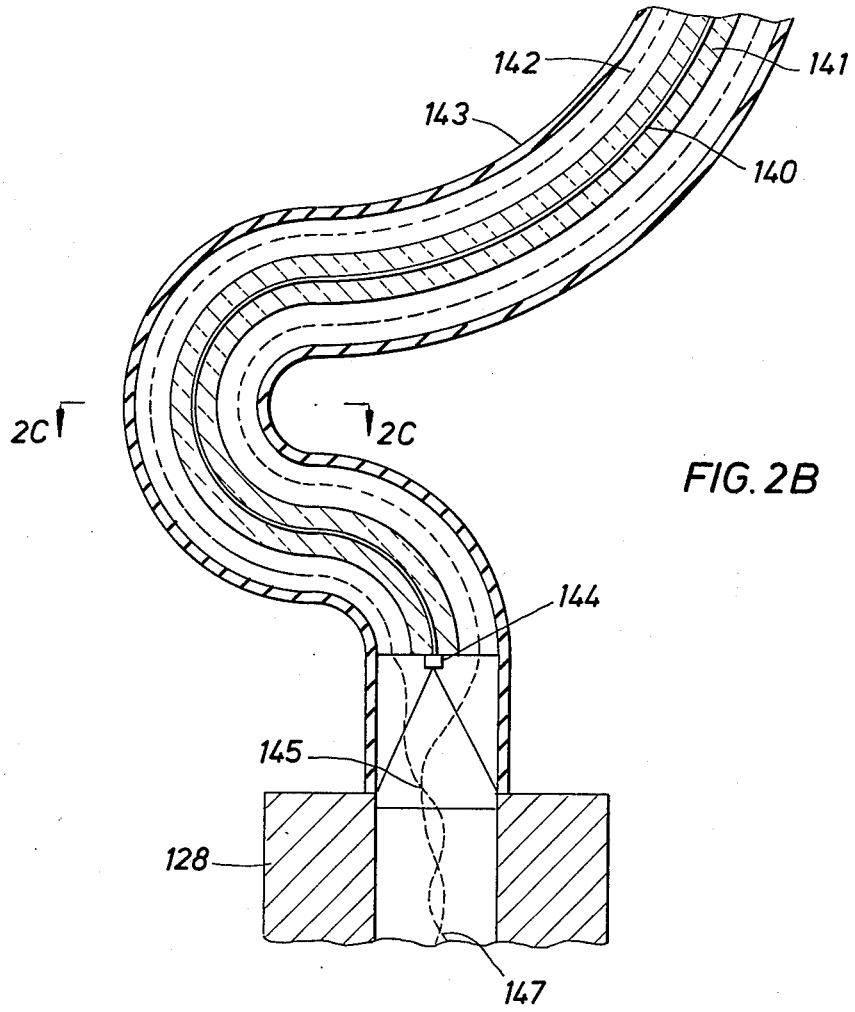
FIGS. 2B and 2C are cross-sectional views of one configuration of coil wire using coaxial cable.
Figure 2C:
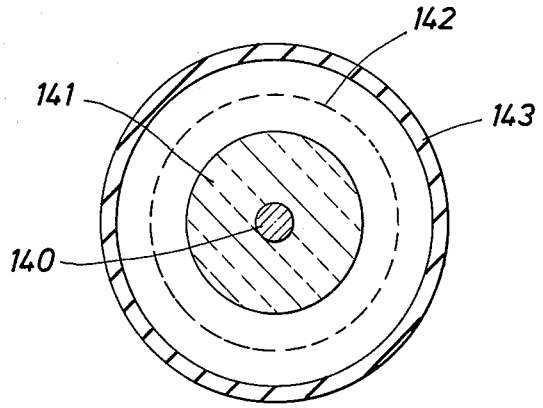

It is contemplated that coil 127 be composed of at least a central coil wire acting as a spring and, if used to conduct information, insulation to electrically isolate the electrical conductor from its downhole environment. In one configuration, the central coil wire is produced from piano wire and serves as the electrical conductor. Alternatively, the central coil wire may be merely a spring and function as a carrier for another conductor or conductors, e.g., single or multi-conductor cable, and carry no electrical signal. Another variation of the coil wire configuration, shown in FIGS. 2B and 2C, entails the use of a coaxial cable having a piano wire, or functionally similar, spring 140 at the cross-sectional center of the coil wire. An inner insulation layer 141 covers the piano wire spring 140. The coaxial braid 142 interspaced between inner insulation layer 141 and outer insulation layer 143 is utilized as the conductor. The coil is attached to the lower coil housing fitting 128 in the manner shown in FIG. 2B. The piano wire spring 140 is stripped of insulation and looped either directly through holes provided in the lower coil housing fitting 128 or through a fitting attached to the lower coil housing fitting and back on itself to form knot 144. Coaxial braid 142 is pulled back from the end of inner insulation layer 141 and formed into pigtails which are soldered or otherwisee connected (at 145) to a conductor 147 which meets with an electrical fitting (not shown) adapted to be attached to lower cable connector 130. Piano wire spring 140 and conductor 147 are kept apart by a suitable insulating medium 146, e.g., molded vulvanized rubber, etc. This coil wire configuration provides a fairly strong mechanical bond between the wire and the coiled wire storage housing at its lower extremity.

It is desirable to vary the size and density of the two insulation layers, 141 and 143, as well as that of the piano wire spring 140 and coaxial braid 142, so as to produce a coil that is not only resilient and self-restoring within the coil housing 125 but also of approximately neutral buoyancy in the drilling fluid. In this way the upper end of the coil will not be called upon to support the extended weight of the lower end. A number of suitable insulation compositions are discussed in U.S. Pat. No. 4,181,184, mentioned above. Variation of conductor and insulation size and density to achieve a coil of neutral buoyancy is desirable no matter which specific configuration of coil is chosen.

The upper end of coil 127, as seen in FIG. 2A, is connected to an extensile wire 131 which, as will be explained infra, extends out through the top of the coil storage means and is connected to the surface via upper cable connector 129.

Cable connector 129 may be an assembly of parts including an adaptor useful in making the transition from the type of wire used as the extensile wire 131 and the type of cable which is to be attached to connector 129. A blind latch and a guide assembly tending to maintain the latch in the center of the drill pipe may also be desirable. It may be useful in operation of the invention to provide cable connector 129 with a threaded portion which will mate with a set of female threads in the outer end of the upper coil housing support 124. These threaded portions would be mated only during handling on the surface to prevent accidental stretching of the coil 127 during that handling.

The cable stop 126 is fitted to the cable at a point between the upper cable connector 129 and the top of the coil 127. It is fashioned to seat on the shoulder 124 at the upper end of the coil housing 125. The cable stop 126 functions as an extension limiter on the coil and thereby prevents permanent stretching by overextension during use. The cable stop 126 desirably may be of a weight sufficient to cause the imposition of some amount of tension on the cables extending to the surface in addition to that caused by the coil 127. Some tension on the surface cables (e.g., 122 in FIG. 1) is desirable, at least to the extent that it prevents those cables from being excessively disturbed by the drilling fluid being pumped through the drill string. The stop 126 should not be of excessive size since when the invention is used in a high angle wellbore, recovery by the coil may be inhibited by the stop 126 dragging on the inside of cable housing 125.

The extensile wire 131 may be of any suitable material. However, if the conductor carrying the information is not of the multiconductor variety, it is contemplated that the extensile wire 131 act as the information carrying conductor although, obviously, this is not necessary.

The length of extensile wire 131 between the upper cable connector 129 and the cable stop 126 constitutes the effective storage capacity of this coiled wire storage means.

Insertion of the preferred apparatus into a drill string during a trip after, for instance, having replaced a drill bit 113 is schematicized in FIGS. 3A–3D.

Figure 3D:
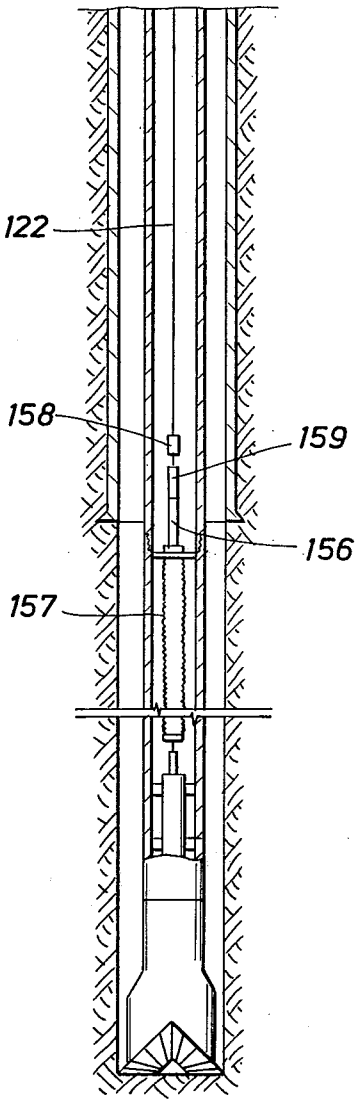
FIGS. 3A to 3D illustrate the method of inserting the coiled wire storage means into a partially drilled well.
Figure 3C:
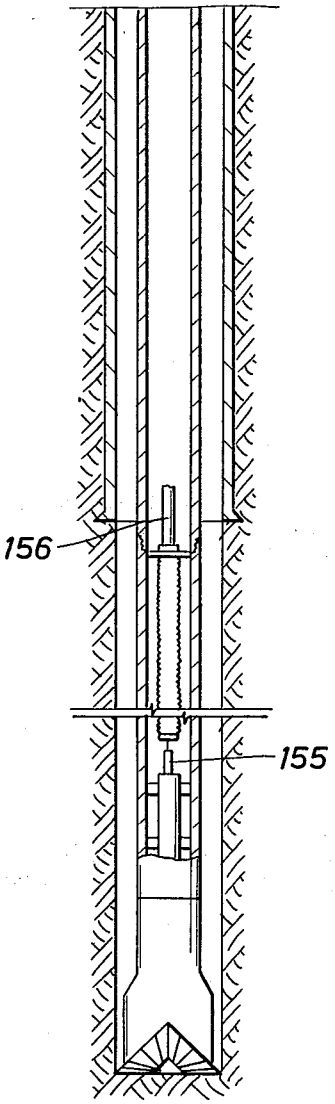
Figure 3B:
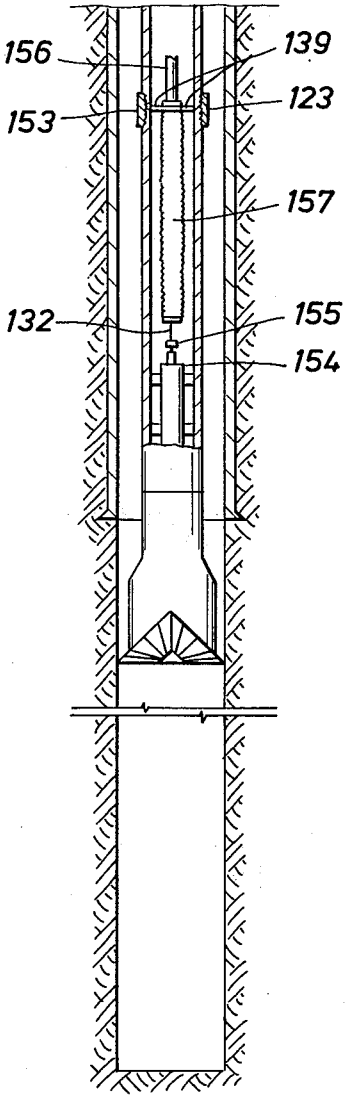
Figure 3A:
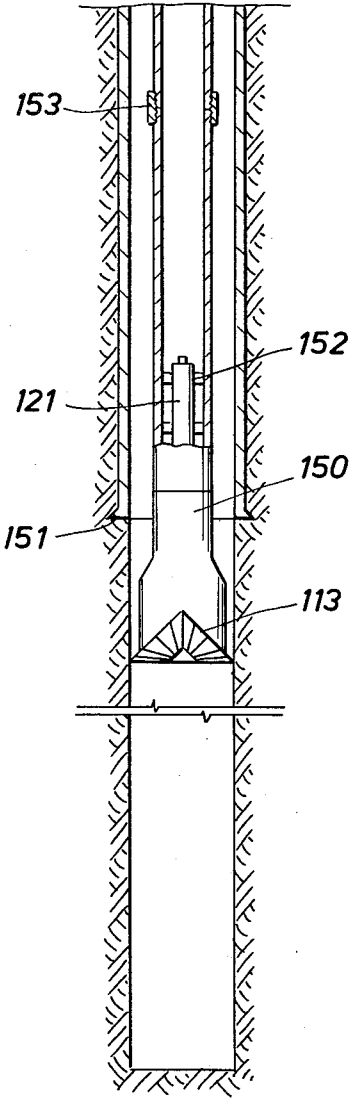

In the first step, as shown in FIG. 3A, a drill bit 113, drill collars 150, sub with instrument collar 152, instrument 121 having a blind instrument latching device for later attachment to a cable, and a sufficient length of drill pipe are all run into the well bore in a normal fashion until the depth of the casing foot 151 is attained. Downward movement of the drill pipe is then stopped. Additional drill collars may be added above the instrument sub 152 during the trip in. A sub 153, to be used for support of the coiled wire storage means, is installed on top of the drill string.

The coiled wire storage means, while on the surface, is then attached to lower cable 132, a blind latch 154 capable of mating with the instrument latch and electric connector of instrument 121, and a jar 155. The lower cable 132 is of such length that the top end of the coiled wire storage means 157 will be at the surface after insertion and securing. The coiled wire storage means 157 thus assembled is then inserted into the drill string as shown in FIG. 3B. After the blind latch 154 is secured to the instrument 121, the housing of the coiled wire storage zone is stretched, the "hang-off" 139 is installed in the sub 153 so as to support the coiled wire storage means 157 by its upper coil housing support 123. The "hang-off" is of such size that the coiled wire storage housing will readily pass, but the upper coil housing support 123 will not. An assembly 156 comprising an electrical connector, a latching device for connection with a cable to the surface, and a guide capable of maintaining the latching device in the approximate center of the drill pipe is attached to the upper cable connector (129 in FIG. 2A) of the coiled wire storage zone 157. The cable is tested by pulling to provide assurance that it is free from the upper coil housing support 123 and the extensile wire (131 in FIG. 2A) will extend out of the coiled wire storage zone during later operation.

The next step, shown in FIG. 3C, entails running the drill string into the hole until the drill bit 113 reaches a point near (e.g., within forty feet of) the bottom of the borehole. The drill string should then be axially exercised to prevent the drill bit 113 and drill string from jamming or sticking in the well bore. During this exercise, shown in FIG. 3D, the surface cable 122 with attached blind latch 159 and associated jar 158 are inserted into the drill string and latched onto the assembly 156 at the top of the coiled wire storage zone 157. Drilling may then commence.

Figure 4A:
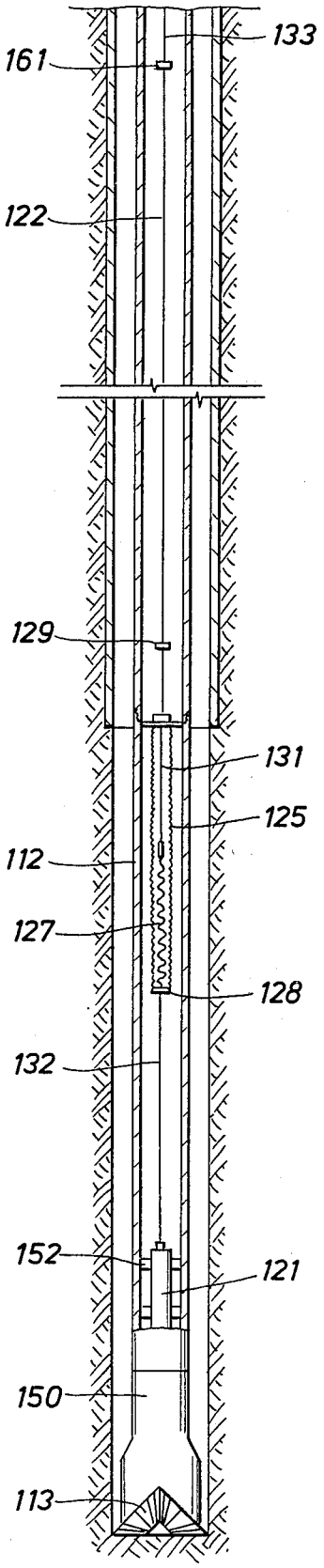
FIGS. 4A to 4C illustrate a method of using the coiled wire storage means.
Figure 4B:
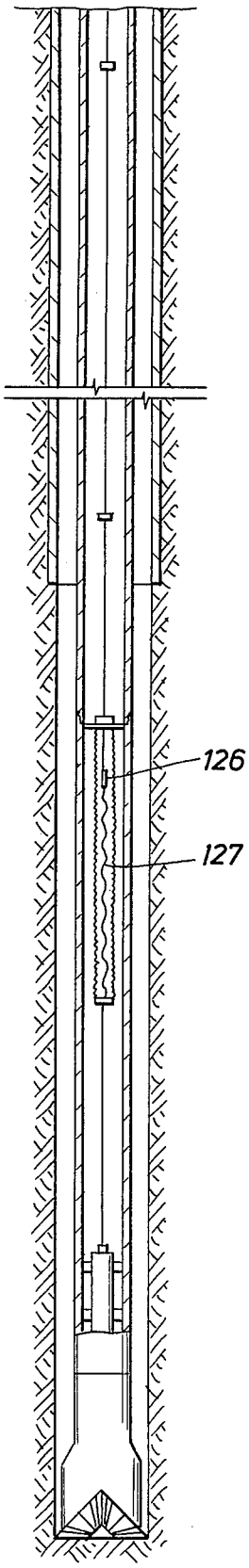
Figure 4C:
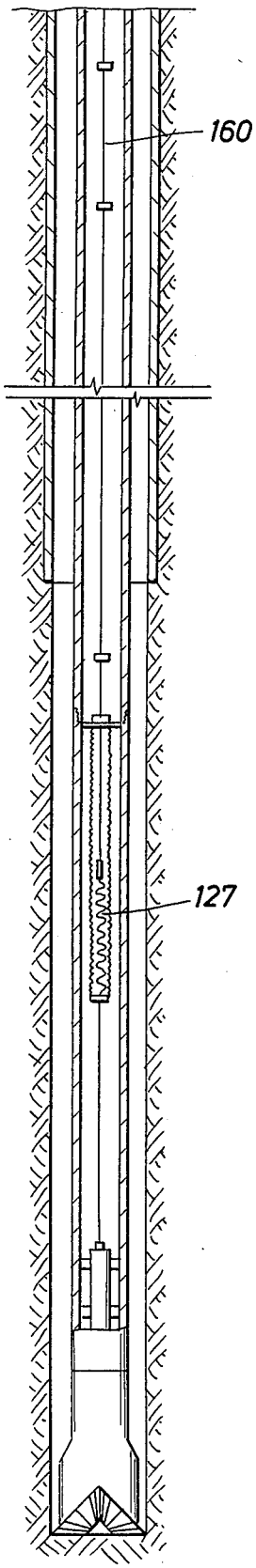

Operation of the inventive apparatus is shown schematically in FIGS. 4A–4C.

A starting point for explanation is shown in FIG. 4A. As discussed above, the drill string 112 turns via torque transmitted from the kelly (not shown) on the surface. The drill string 112 has at its lowermost end, a drill bit 113, drill collars 150, instrument collar 152, and instrument 121. The instrument 121 is attached to the coiled wire storage means via lower cable 132 (various components, e.g., connectors, have been deleted from these drawings for the purpose of clarity). The tension on lower cable 132 is transferred to the housing of the coiled wire storage means at its lower fitting 128. Electrical continuity to the surface is provided from the instrument 121 through lower cable 132, coil 127, extensile wire 131, cable connector 129, surface cable 122, cable connector 161, and kelly cable 133. In FIG. 4A, the coil 127 is in a collapsed state. As drilling progresses and a new section of drill pipe added, kelly cable 133 is disconnected at cable connector 161, surface cable 122 is pulled up through the new section of drill pipe and reconnected at cable connector 161 to kelly cable 133. Drilling is then re-commenced. The result of adding several sections of drill pipe is shown in FIG. 4B. It is to be observed that coil 127 has been extended from its at-rest position in FIG. 4A and coil stop 126 is approaching the upper end of the coil housing. The number of drill pipe sections which may be added before additional cable is necessary before the kelly cable 133 and a lower cable, e.g., surface cable 122, is dependent upon the length of the coil storage housing 125 and, more directly, upon the extension capability of the coil 127.

For instance, if the coil storage housing 125 has a length of 400 feet and the coil fills about half of that distance, then the coil 127 may have a nominal extension capability of 200 feet. Since drill pipe sections come in lengths of approximately 31 feet, six sections of pipe, using 186 feet of the possible 200 feet, may be attached prior to the addition of another cable.

FIG. 4C illustrates the manner in which coil 127 retracts after an additional length of cable 160 has been attached. In the example, added cable 160 is about 186 feet long and replaces six cables of the traditional 31 foot length with their associated connectors. It should be apparent that the expenditure for the additional connectors is thereby eliminated. The deletion of these connectors enhances the reliability of the electrical signal received at the surface in that the majority of electrical failures in these and prior art cable strings occur at the cable connectors.

Although the present invention has been described with reference to conventional rotary drilling operations, it can also be used with other types of drilling equipment including turbodrills and positive displacement hydraulic motors. These devices normally include a motor or turbine mounted on the lower end of the drill string and adapted to connect to and drive a bit. The motor or turbine powered by the drilling fluid drives the drill bit while the drill string remains stationary. When this type of subsurface drilling device is used in directional drilling operations, the present invention provides a highly useful means for transmitting directional data to the surface.

The inventive device may also be used in well-logging operations both where the drill bit is not in place and when actual drilling is not taking place; e.g. during running out of the hole.

The foregoing disclosure and description of the invention are only illustrative and explanatory thereof. Various changes in size, shape, materials of construction, and configuration as well as in the details of the illustrated construction may be made within the scope of the appended claims without departing from the spirit of the invention.

We claim:

1. An apparatus for downhole storage of an electrical conductor in a drill string comprising:

a coil housing adapted to be attached to the interior of a drill pipe; and an extensile wire attached at its first end to the first end of a coil and having a second end extendible out of the coil housing;

a self-collapsing spring coil located within the coil housing; having a length, when collapsed, less than that of the coil housing; attached at its first end to the extensile wire and at its second end to the end of the coil housing opposite that from which the extensile wire is extendible.

2. The apparatus of claim 1 wherein the stored electrical conductor comprises the coil and extensile wire.

3. The apparatus of claim 1 wherein the stored electrical conductor is supported by the coil.

4. The apparatus of claim 3 wherein the stored electrical conductor is single or multi-conductor wire.

5. The apparatus of claim 1 further including means for preventing over-extension of the coil.

6. An apparatus for downhole storage of an electrical conductor in a drill string comprising:

a flexible coil housing adapted to be attached to the interior of a drill pipe;

an extensile wire attached at its first end to the first end of a coil and having a second end extending out of the coil housing;

a self-collapsing spring coil located within the coil housing; having a length, when collapsed, less than that of the coil housing; attached at its first end to the extensile wire and at its second end to the end of the coil housing opposite that from which the extendible wire extends.

7. The apparatus of claim 6 wherein the stored electrical conductor comprises the coil and extensile wire.

8. The apparatus of claim 6 wherein the stored electrical conductor is supported by the coil.

9. The apparatus of claim 8 wherein the stored electrical conductor is single or multi-conductor wire.

10. The apparatus of claim 6 further including means for preventing over-extension of the coil.

11. An apparatus for downhole storage of an electrical conductor in a drill string comprising:

a flexible coil housing;

a first coil housing fitting means attached at one end of the coil housing adapted to be attached to the interior of a drill pipe; and, having a hole therethrough approximately longitudinally axial to the first coil housing fitting means and the coil housing, said hole being of sufficient size to permit passage of an extensile wire;

a second coil housing fitting means attached at the opposite end of the coil housing; adapted to be attached to a coil located within the coil housing; having insulator means for electrically isolating at least one electrical conductor from the second coil housing fitting means while permitting access to the electrical conductor means both inside the coil housing and outside the second coil housing fitting means;

a self-collapsing spring coil located within the coil housing; having a length, when collapsed, less than that of the coil housing; having a diameter which allows longitudinal axial movement of the coil within the coil housing; attached at its first end to an extensile wire and at its second end to the second coil housing fitting;

an extensile wire attached at its first end to the first end of the coil and having a second end extending through the hole in the first coil housing means;

a shoulder means at or near the coil housing end of the hole through the first coil housing fitting means;

a coil stop of a size that will not pass the shoulder means which is attached to the extensile wire in such a position between the first end of the coil and the first coil housing fitting means that the coil may be extended but not overextended.

12. The apparatus of claim 11 wherein the second coil housing fitting means includes electrical connector means suitable for connecting to further connector means.

13. The apparatus of claim 12 wherein both said connector means are cable connectors.

14. The apparatus of claim 11 wherein at least one of the first coil housing fiting means and the second coil housing fitting means is adapted to allow the passage of drilling fluids.

15. The apparatus of claim 11 wherein the coil housing comprises corrugated metal hose.

16. The apparatus of claim 15 wherein the corrugated metal hose is additionally covered with at least one layer of metal braid.

17. The apparatus of claims 15 or 16 wherein the metals are selected from the group consisting of stainless steels.

18. The apparatus of claim 11 wherein the coil is insulated piano wire connected at its second end to an electrical connector means electrically isolated from the second coil housing fitting means, attached at its first end to the extensile wire; the extensile wire being insulated.

19. The apparatus of claim 11 wherein the coil supports a stored electrical conductor comprising single or multi-conductor wire.

20. The apparatus of claims 1, 6, 11, 18 or 19 wherein the coil and the electrical conductor are of approximately neutral bouyancy in a drilling fluid.

21. The apparatus of claim 11 wherein the shoulder means are integral with the first coil housing fitting means.

22. The apparatus of claim 20 wherein the collapsed coil occupies from 1/6 to ½ of the length of the coil housing.

23. The apparatus of claim 18 wherein an electrical cable connector having both electrical and mechanical mating means is physically and electrically attached to the extensile wire.

24. The apparatus of claim 23 further including guide means for maintaining the electrical cable connector in the approximate center of a drill pipe and blind latch means for attaching to mating latch means.

25. The apparatus of claim 11 wherein the coil is the electrical conductor.

26. A drilling apparatus having a sectionalized tubular drill string, a rotary drill bit connected thereto, and means for adding additional pipe sections to said drill string, an insulated electric conductor disposed within said drill string and having a lower end at a subsurface location, an upper end proximate the upper end of said drill string, an intermediate portion arranged as a spring coil within a flexible coiled wire storage means, which means is supported in the drill string, and a connector at said upper end, said connector being adapted to permit the addition of pipe sections to the upper end of said drill string upon elevating said upper end of said conductor relative to said drill string and thereby permitting said conductor to be extended through additional pipe sections added to said drill string.

27. A method for logging a borehole while drilling comprising the steps of:

installing a logging instrument suitable for logging a physical parameter in a drill string, said drill string comprising pipe sections, storing at least a portion of an insulated electrical conductor in the drill string by curling it above said instrument, said portion being stored in a flexible housing located within said drill string and connected both to said logging instrument and to receiver capable of monitoring said logging instrument at the upper end of the drill string, said portion of insulated electrical conductor and said flexible housing being adapted to store a length of said portion substantially longer than more than one pipe section, logging a subsurface physical parameter while drilling.

28. The method of claim 27 wherein the borehole is non-vertical.

29. The method of claim 28 wherein the borehole is an underground river crossing.

30. The method of claim 27 wherein the borehole is a gas bleed hole extending to the vicinity of or into a coal seam.

31. The method of claim 28 wherein the borehole is an oil or gas well.

32. The method of claim 28, 29, 30 and 31 wherein the physical parameter is bit position.

33. A method for logging a borehole comprising the steps of:

installing a logging instrument suitable for logging a physical parameter in a drill string said drill string comprising pipe sections, storing at least a portion of an insulated electrical conductor in the drill string by coiling it above said instrument, said portion being stored in a flexible housing located within said drill string and connected both to said logging instrument and to a receiver capable of monitoring said logging instrument at the upper end of the drill string said portion of insulated electrical conductor and said flexible housing being adapted to store a length of said portion substantially longer than at least one pipe section, logging a subsurface physical parameter.

34. The method of claim 33 wherein the borehole is non-vertical.

35. The method of claim 34 wherein the borehole is in underground river crossing.

36. The method of claim 33 wherein the borehole is a gas bleed hole extending to the vicinity of or into a coal seam.

37. The method of claim 34 wherein the borehole is an oil or gas well.

* * * * *